US012628921B2

(12) United States Patent
Yuan et al.

(10) Patent No.: US 12,628,921 B2
(45) Date of Patent: May 19, 2026

(54) WEARABLE ELECTRONIC APPARATUS

(71) Applicant: Huawei Technologies Co., Ltd., Shenzhen (CN)

(72) Inventors: Shenglan Yuan, Dongguan (CN); Bin Zhang, Dongguan (CN); Tianyu Cheng, Dongguan (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 273 days.

(21) Appl. No.: 18/555,918

(22) PCT Filed: Apr. 2, 2022

(86) PCT No.: PCT/CN2022/085001
§ 371 (c)(1),
(2) Date: Oct. 18, 2023

(87) PCT Pub. No.: WO2022/222740
PCT Pub. Date: Oct. 27, 2022

(65) Prior Publication Data

US 2024/0206603 A1 Jun. 27, 2024

(30) Foreign Application Priority Data

Apr. 20, 2021 (CN) ..... 202120820908.2

(51) Int. Cl.
*A44C 5/14* (2006.01)

(52) U.S. Cl.
CPC ..... *A44C 5/14* (2013.01)

(58) Field of Classification Search
CPC ..... A44C 5/14; A44C 5/147; G04B 37/1486; G04B 37/1493; Y10T 24/4718; Y10T 24/2155; Y10T 24/3984; Y10T 24/4782
See application file for complete search history.

(56) References Cited

U.S. PATENT DOCUMENTS

| | | | | |
|---|---|---|---|---|
| 6,014,793 | A | 1/2000 | Howald | |
| 10,993,512 | B2 * | 5/2021 | Rochat | G04B 37/1493 |
| 11,019,889 | B2 * | 6/2021 | Nicolas | G04B 37/1486 |
| 11,022,943 | B2 * | 6/2021 | Romano | G04B 37/1486 |
| 11,419,394 | B2 * | 8/2022 | Chen | A44C 5/14 |

FOREIGN PATENT DOCUMENTS

| | | | |
|---|---|---|---|
| CN | 206006226 | U | 3/2017 |
| CN | 109924618 | A | 6/2019 |
| CN | 210726885 | U | 6/2020 |
| CN | 212661273 | U | 3/2021 |
| CN | 215455886 | U | 1/2022 |
| JP | 2017047156 | A | 3/2017 |

* cited by examiner

*Primary Examiner* — Edwin A. Leon
(74) *Attorney, Agent, or Firm* — Conley Rose, P.C.

(57) ABSTRACT

A wearable electronic apparatus includes a body and a band. The body includes a shaft hole, and the band includes a connection part, two spring bar pins, two first springs, a button, two second springs, and a cover. The connection part includes an accommodation cavity, and the accommodation cavity includes two first openings and one second opening. Each spring bar pin is slidably disposed in the accommodation cavity at the first opening. Each spring bar pin includes a matching end and a mounting end that are opposite to each other. The matching end is configured to cooperate with the button, and the mounting end is configured to be accommodated in the shaft hole.

20 Claims, 7 Drawing Sheets

63

17

18

WEARABLE ELECTRONIC APPARATUS

CROSS-REFERENCE TO RELATED APPLICATIONS

This is a U.S. National Stage of International Patent Application No. PCT/CN2022/085001 filed on Apr. 2, 2022, which claims priority to Chinese Patent Application No. 202120820908.2 filed on Apr. 20, 2021. Both of the aforementioned applications are hereby incorporated by reference in their entireties.

TECHNICAL FIELD

This application relates to the field of wearable device technologies, and in particular, to a wearable electronic apparatus.

BACKGROUND

Currently, to disassemble or assemble an element of a wearable electronic apparatus 1, for example, to disassemble or assemble a watch band 10, two levers 11 are exposed from the wearable electronic apparatus 1 for a user operation, as shown in FIG. 1. Refer to FIG. 2. Each lever 11 is fastened to one spring bar pin 12, two spring bar pins 12 are connected through a spring 13. The spring bar pin 12 and the spring 13 are disposed in a spring bar pipe 14, and the lever 11 is exposed from the spring bar pipe 14. The spring bar pipe 14 is disposed in the wearable electronic apparatus 1. The lever 11, the spring bar pin 12, the spring 13, and the spring bar pipe 14 form a connection structure 15. The watch band 10 and a watch body 20 are detachably connected through the connection structure 15. A user may drive the two spring bar pins 12 to move toward each other by sliding the levers 11, to disassemble or assemble the watch band 10. However, when the watch band 10 is disassembled by using the levers 11, operation experience of the levers 11 is relatively poor, and disassembly or assembly efficiency is low. In addition, a fingernail is likely to be injured when the lever 11 is operated. Because the lever 11 is small and raised, there is a risk that the lever 11 scratches skin and clothes.

SUMMARY

In view of the foregoing content, it is needed to provide a wearable electronic apparatus, to facilitate disassembly or assembly of an element of the wearable electronic apparatus.

An embodiment of this application provides a wearable electronic apparatus, where the wearable electronic apparatus includes a first unit and a second unit. The first unit includes a shaft hole, and the second unit includes a connection part, two spring bar pins, two first springs, a button, two second springs, and a cover. The connection part includes an accommodation cavity, and the accommodation cavity includes two first openings and one second opening. Each spring bar pin is slidably disposed in the accommodation cavity at the first opening. Each spring bar pin includes a matching end and a mounting end that are opposite to each other. The matching end is configured to cooperate with the button, and the mounting end is configured to be accommodated in the shaft hole. The two first springs are configured to provide elastic force for the two spring bar pins to move toward each other. The two first springs are configured to enable the spring bar pins to apply first acting force F1 to the button when mounting ends are accommodated in shaft holes. The button is slidably disposed in the accommodation cavity at the second opening. A sliding direction of the button is perpendicular to a sliding direction of the spring bar pin. The button includes an inclined guide surface, and the button cooperates with the matching end through the guide surface. The two second springs are configured to provide elastic force toward an outside of the connection part for the button, and are configured to provide, through guide surfaces, elastic force for the two spring bar pins to move away from each other, so that the mounting ends are accommodated in the shaft holes. The two second springs are configured to provide second acting force F2 for the button when the button is not operated, where the second acting force F2 is greater than the first acting force F1. The cover is fastened to the connection part, the cover abuts against the button, and a button slot is formed on the cover, so that the button is partially exposed from the cover.

In this solution, the two second springs provide the relatively large elastic force toward the outside of the connection part for the button, and provide, through the guide surfaces when the button is not operated, the elastic force for the two spring bar pins to move away from each other, so that the spring bar pins are pushed to enable the mounting ends of the spring bar pins to be accommodated in the shaft holes of a watch body. This has a mass production capability, and can implement quick locking of a watch band and the watch body. In addition, the cover is fastened to the connection part, to offset the upward elastic force provided by the second springs for the button, to prevent the button from detaching from the connection part under the elastic force of the second springs. This has a mass production capability. The button is operated, so that the mounting ends of the spring bar pins contract inward under the elastic force of the first springs. This implements quick unlocking of the watch band and the watch body, facilitating quick disassembly or assembly.

According to some embodiments of this application, a surface of the connection part is concave at an edge to form a bottom surface and a side wall, and the bottom surface and the side wall form an accommodation groove. A sliding groove is formed at a connection between the side wall and the bottom surface, so that the side wall is in a stepped shape. The second opening is formed in the bottom surface, and the accommodation groove communicates with the accommodation cavity through the second opening. The cover includes a cover body and a lip edge provided at a side edge of the cover body, and the button slot runs through opposite surfaces of the cover body and through an edge of the cover body. The cover body is accommodated in the accommodation groove, and the lip edge is accommodated in the sliding groove.

In this solution, the cover body is accommodated in the accommodation groove, the lip edge is accommodated in the sliding groove, and the cover abuts against the button, so that the cover is fastened to the connection part. The button slot runs through the opposite surfaces of the cover body and through the edge of the cover body, so that the cover is conveniently assembled.

According to some embodiments of this application, a spacing exists between the button and an inner wall of the connection part. A limit snap-fit is further disposed far away from the edge on a side that is of the cover body and that faces the bottom surface, and the limit snap-fit is clamped on the inner wall of the connection part through the spacing.

In this solution, the limit snap-fit is clamped on the inner wall of the connection part through the spacing, so that the cover may be securely locked on the connection part.

According to some embodiments of this application, the wearable electronic apparatus includes a fixing member, a through hole is formed in the connection part near the accommodation groove, and the lip edge includes a crescent hole provided at an edge of the lip edge. The through hole is used to accommodate a part of the fixing member, and the crescent hole is used to accommodate the other part of the fixing member.

In this solution, the crescent hole is provided, so that the lip edge does not need to be relatively wide. This simplifies a processing process of the sliding groove, reduces process implementation complexity and is suitable for industrial mass production. The cover is securely locked on the connection part by using the fixing member, which facilitates assembly, disassembly and repair of the cover, and improves a mass production capability of the wearable electronic apparatus.

According to some embodiments of this application, the lip edge includes the crescent hole that runs through opposite surfaces of the lip edge and through the edge of the lip edge.

According to some embodiments of this application, the second springs are in a compressed state when the button is not operated.

In this solution, the second springs are in the compressed state when the button is not operated, so that the button may apply relatively strong acting force to the spring bar pins. In this case, the mounting ends of the spring bar pins can move and are accommodated in the shaft holes of the watch body.

According to some embodiments of this application, the first springs are in the compressed state when the mounting ends are away from the shaft holes.

In this solution, the first springs are in the compressed state when the mounting ends are far away from the shaft holes. In this case, when the mounting ends are accommodated in the shaft holes, the elastic force provided by the first springs enables the mounting ends to move out of the shaft holes. This allows the second unit to be disassembled from the first unit.

According to some embodiments of this application, the accommodation cavity includes two first accommodation cavities and a second accommodation cavity. The second accommodation cavity is provided between the two first accommodation cavities, and communicates with each of the first accommodation cavities. A limit member is formed in the connection part at a connection at which each of the first accommodation cavities communicates with the second accommodation cavity. The spring bar pin further includes an abut member between the matching end and the mounting end. A diameter of the abut member is greater than a diameter of the matching end and greater than a diameter of the mounting end. The abut member is configured to abut against the limit member.

In this solution, the limit member is formed in the connection part at the connection at which each of the first accommodation cavities communicates with the second accommodation cavity. In this case, when the abut member enters the second accommodation cavity, the abut member is not stuck in an inner wall of the connection part at the connection at which the first accommodation cavity communicates with the second accommodation cavity, to avoid that the button cannot be assembled. This has a mass production capability.

According to some embodiments of this application, a diameter of the mounting end is less than a diameter of another part of the spring bar pin.

In this case, the diameter of the mounting end is less than the diameter of the another part of the spring bar pin, so that the spring bar pin has relatively high impact-resistance strength and good drop resistance.

According to some embodiments of this application, the first unit is a watch body, and the second unit is a watch band.

In this solution, the first unit is the watch body, and the second unit is the watch band, so that inconvenient assembly caused by an excessively narrow second unit can be prevented.

DESCRIPTION OF EMBODIMENTS

In the following description, terms "first" and "second" are merely intended for a purpose of description, and shall not be interpreted as indicating or implying relative importance or implying a quantity of indicated technical features. Therefore, a feature defined with "first" or "second" may explicitly or implicitly include one or more features. In descriptions of embodiments of this application, the terms such as "for example" are used to represent giving an example, an illustration, or a description. Any embodiment or design solution described as "for example" in embodiments of this application shall not be explained as being more preferred or having more advantages than another embodiment or design solution. To be precise, the terms such as "for example" are intended to present a related concept in a specific manner.

Unless otherwise defined, all technical and scientific terms used in this specification have same meanings as those usually understood by a person skilled in the art of this application. The terms used in this specification of this application are merely for a purpose of describing specific embodiments, but are not intended to limit this application.

Figure 1:
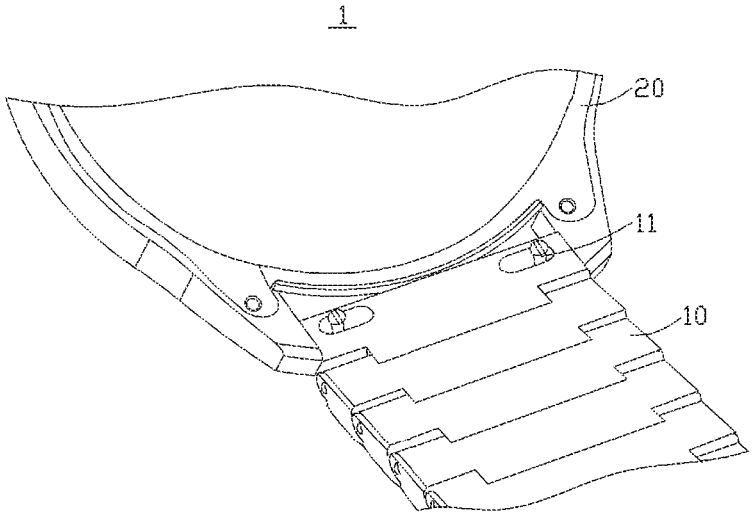
FIG. 1 is a schematic diagram of a connection between a watch band and a watch body of a conventional wearable electronic apparatus.
Figure 2:
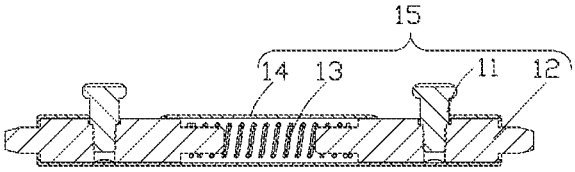
FIG. 2 is a schematic sectional diagram of a conventional connection structure.
Figure 3:
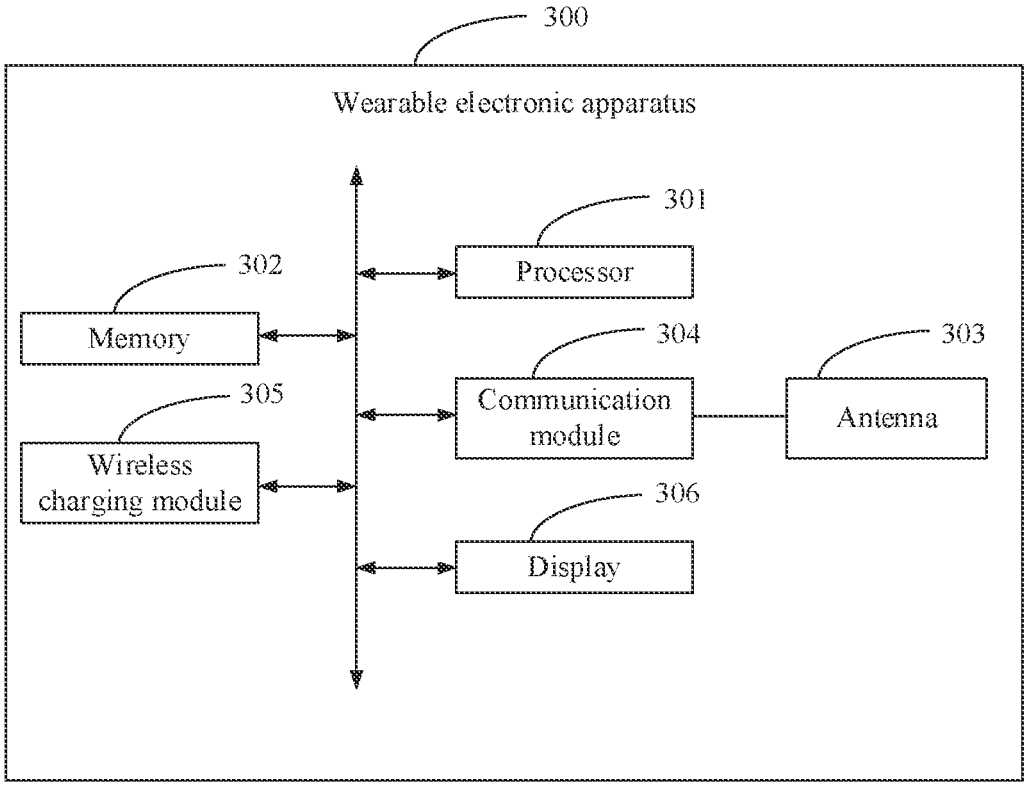
FIG. 3 is a schematic diagram of a wearable electronic apparatus according to this application.

FIG. 3 is a schematic diagram of a wearable electronic apparatus 300 according to this application. The wearable electronic apparatus 300 may be a watch, a wristband, or the like. The wearable electronic apparatus 300 may include a processor 301, a memory 302, an antenna 303, a communication module 304, a wireless charging module 305, a display 306, and the like. A person skilled in the art may understand that a structure shown in FIG. 3 does not constitute a limitation on the wearable electronic apparatus 300. The wearable electronic apparatus 300 may include more or fewer components than those shown in the figure, or some components may be combined, or some components may be split, or there may be a different component layout.

The processor 301 may be a central processing unit (Central Processing Unit, CPU), or may be another general-purpose processor, a digital signal processor (Digital Signal Processor, DSP), an application-specific integrated circuit (Application Specific Integrated Circuit, ASIC), a field-programmable gate array (Field-Programmable Gate Array, FPGA) or another programmable logic device, a discrete gate or a transistor logic device, a discrete hardware component, or the like. The processor 301 may be a microprocessor, or the processor may be any conventional processor, or the like. The processor 301 is a control center of the wearable electronic apparatus 300, and is connected to all parts of the entire wearable electronic apparatus 300 by using various interfaces and lines.

The memory 302 may be configured to store a software program and/or a module/unit. The processor 301 implements various functions of the wearable electronic apparatus 300 by running or executing the software program and/or the module/unit stored in the memory 302 and invoking data stored in the memory 302. The memory 302 may mainly include a program storage area and a data storage area. The program storage area may store an operating system, an application required by at least one function (for example, a sound playing function or an image playing function), and the like. The data storage area may store data (for example, audio data) and the like that are created based on use of the wearable electronic apparatus 300. In addition, the memory 302 may include a non-volatile computer-readable memory, such as a hard disk, an internal memory, a plug-in hard disk, a smart media card (Smart Media Card, SMC), a secure digital (Secure Digital, SD) card, a flash card (Flash Card), at least one magnetic disk storage device, a flash memory apparatus, or another non-volatile solid-state storage apparatus.

The antenna 303 may be configured to transmit and receive an electromagnetic wave signal.

The communication module 304 may be a wireless communication module such as a WLAN (for example, a Wi-Fi network). BR/EDR, BLE, GNSS, or FM. Alternatively, the communication module 304 may be a communication module that can transmit a signal through the antenna 303, so that another device can discover the communication module.

The wireless charging module 305 may include a charging coil, and is configured to be coupled to the charging coil in a charging base, to implement wireless charging for the wearable electronic apparatus 300. The charging coil may be an FPC (Flexible Printed Circuit, flexible printed circuit) coil or the like.

The display 306 may be configured to display an image, prompt information, and the like. The display 306 may be a liquid crystal display (liquid crystal display, LCD), an organic light-emitting diode (organic light-emitting diode. OLED) display, an active-matrix organic light-emitting diode (active-matrix organic light-emitting diode, AMOLED) display, a flexible light-emitting diode (flexible light-emitting diode, FLED) display, a quantum dot light-emitting diode (quantum dot light-emitting diode, QLED) display, or the like.

This embodiment uses an example in which the wearable electronic apparatus 300 is a watch for description. It may be understood that, in this embodiment of this application, the wearable electronic apparatus 300 may alternatively be another wearable electronic apparatus such as a wristband.

Figure 4:
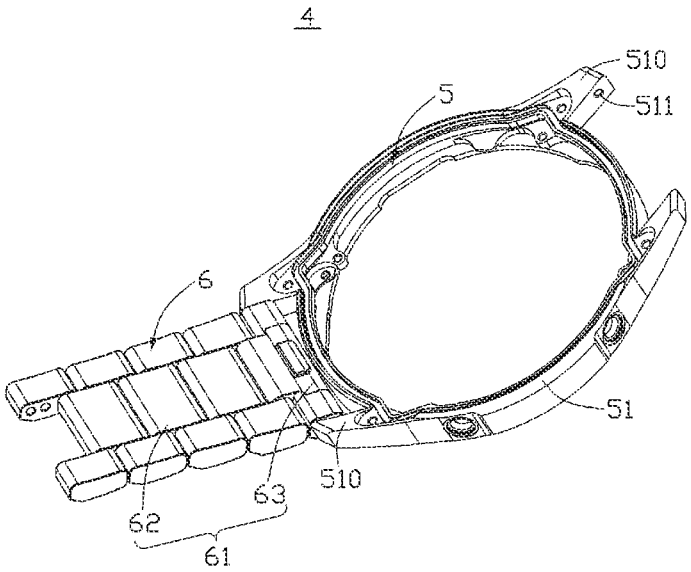
FIG. 4 is a schematic diagram of a watch according to a first embodiment of this application.

FIG. 4 is a schematic diagram of a watch according to a first embodiment of this application. The watch 4 includes a first unit 5 and a second unit 6. The first unit 5 is a watch body 51. The second unit 6 is a watch band 61. FIG. 4 shows merely a partial structure of the watch body 51. However, it may be understood that, an accommodation space is formed in the entire watch body 51, and may be used to accommodate a processor, a memory, a communication module, and a wireless charging module. An antenna may be disposed inside the watch body 51 or disposed outside the watch body 51. A display may be disposed on a surface of the watch body 51. Edges of the watch body 51 include two pairs of lugs 510. Shaft holes 511 disposed opposite to each other are formed on each pair of lugs 510. The shaft hole 511 may be a blind hole or a through hole. The watch band 61 is detachably connected to the watch body 51 through the shaft holes 511.

Refer to FIG. 5 to FIG. 8. The watch band 61 includes a plurality of links 62 and a connection base 63. The plurality of links 62 are connected to one end of the connection base 63. The other end of the connection base 63 is detachably connected to the watch body 51 through the shaft holes 511. The connection base 63 includes a connection part 64, two spring bar pins 66, two first springs 67, a clamping ring 68, a button 69, two second springs 70, and a cover 71. The connection part 64 includes a T-shaped accommodation cavity 640. The accommodation cavity 640 includes two first accommodation cavities 641 and a second accommodation cavity 642. The second accommodation cavity 642 is provided between the two first accommodation cavities 641, and communicates with each of the first accommodation cavities 641. A limit member 643 is formed in the connection part 64 at a connection at which each of the first accommodation cavities 641 communicates with the second accommodation cavity 642. In this embodiment, the limit member 643 extends inward in a radial direction from an inner wall 645 of the connection part 64 at the connection at which the first accommodation cavity 641 communicates with the second accommodation cavity 642. In this case, the limit member 643 may block a part of the connection between the first accommodation cavity 641 and the second accommodation cavity 642. In this embodiment, the limit member 643 is in a circular-ring shape. In another embodiment, the limit member 643 is in a ring shape or another shape. The accommodation cavity 640 includes two opposite first openings 646 and one second opening 647. The first accommodation cavity 641 includes the first opening 646. The second accommodation cavity 642 includes the second opening 647. A surface of the connection part 64 is concave at an edge to form a bottom surface 648 and a side wall 649. The bottom surface 648 and the side wall 649 form an accommodation groove 650. A sliding groove 651 is formed at a connection between the side wall 649 and the bottom surface 648, so that the side wall 649 is in a stepped shape. The second opening 647 is formed in the bottom surface 648. The accommodation groove 650 communicates with the second accommodation cavity 642 through the second opening 647.

Each spring bar pin 66 is slidably accommodated in one first accommodation cavity 641. The spring bar pin 66 includes a matching end 660 and a mounting end 661 that are opposite to each other. The matching end 660 is configured to abut against and cooperate with the button 69, and the mounting end 661 is configured to be accommodated in the shaft hole 511. An end face of the matching end 660 is in an arc shape. When the matching end 660 is in a first position, the mounting end 661 is accommodated in the shaft hole 511. When the matching end 660 is in a second position, the mounting end 661 is far away from the shaft hole 511. The spring bar pin 66 further includes an abut member 662 between the matching end 660 and the mounting end 661. A diameter of the abut member 662 is greater than a diameter of the matching end 660, and is greater than a diameter of the mounting end 661. The abut member 662 is configured to abut against the limit member 643. In this way, when the abut member 662 enters the second accommodation cavity 642 in a sliding process of the spring bar pin 66, the abut member 662 is not stuck in the inner wall 645 of the connection part 64 at the connection at which the first accommodation cavity 641 communicates with the second accommodation cavity 642. When the matching end 660 is in the first position, the abut member 662 abuts against the limit member 643. The diameter of the mounting end 661 is less than a diameter of another part of the spring bar pin 66, so that the spring bar pin 66 has relatively high impact-resistance strength and good drop resistance.

Each first spring 67 is sleeved on one spring bar pin 66. A first end of each first spring 67 abuts against one abut member 662. When two matching ends 660 are in the first position, the two first springs 67 are in a compressed state. In this way, when the two matching ends 660 are in the second position, elastic force provided by the first springs 67 can enable mounting ends 661 to move out of the shaft holes 511. When the two matching ends 660 are in the second position, the two first springs 67 are in the compressed state, and are configured to provide elastic force for the two spring bar pins 66 to move toward each other. In this case, the two spring bar pins 66 apply first acting force F1 to the button 69. When the matching end 660 is in the first position, the first spring 67 is in the compressed state. In this case, the abut member 662 may abut against the limit member 643, to resist the elastic force provided by the first spring 67 for the spring bar pin 66. In this way, when the abut member 662 enters the second accommodation cavity 642, the abut member 662 is not stuck in the inner wall 645 of the connection part 64 at the connection at which the first accommodation cavity 641 communicates with the second accommodation cavity 642. In addition, when the matching end 660 is in the first position, the first spring 67 is in the compressed state. In this case, when the matching end 660 is in the second position, the first spring 67 provides greater elastic force to the spring bar pin 66, and the spring bar pin 66 also applies greater force to the button 69.

The clamping ring 68 is fastened to the first opening 646. For each first spring 67, a second end that is opposite to the first end abuts against the clamping ring 68. In this embodiment, the clamping ring 68 is in interference fit with the first opening 646, so that the clamping ring 68 is fastened to the first opening 646, to prevent the spring bar pin 66 and the first spring 67 from detaching from the first opening 646. Optionally, the clamping ring 68 is further fastened to the first opening 646 through a thread connection, welding, or the like. The spring bar pin 66 passes through the clamping ring 68, so that when the matching end 660 is in the first position, the spring bar pin 66 may be exposed from the clamping ring 68; and when the matching end 660 is in the second position, the spring bar pin 66 is accommodated in the first accommodation cavity 641.

The button 69 is slidably disposed in the second accommodation cavity 642. A sliding direction of the button 69 is perpendicular to a sliding direction of the spring bar pin 66. There is a spacing between the button 69 and the inner wall 645 of the connection part 64. At least two accommodation blind holes 692 are formed in a bottom 691 of the button 69. The accommodation blind hole 692 is configured to accommodate the second spring 70. The button 69 includes an operation part 693 and an adjustment part 694. The operation part 693 is configured to be operated by a user. The adjustment part 694 is fastened to the operation part 693. A step surface 695 is formed at a connection between the adjustment part 694 and the operation part 693. In this embodiment, the adjustment part 694 includes two symmetrically disposed guide surfaces 696. The guide surface 696 may be a plane, a curve, or the like. The guide surface 696 is connected to the step surface 695 at an inclined angle. A distance between first ends 697 that are of the two guide surfaces 696 and that are away from step surfaces 695 is greater than a distance between second ends 698 of the two guide surfaces 696 close to the step surfaces 695, so that a cross section of the adjustment part 694 is approximately in an isosceles trapezoid shape. In another embodiment, the adjustment part 694 is in a truncated cone shape. The adjustment part 694 includes the guide surface 696. One end of the adjustment part 694 with a smaller radius is fastened to the operation part 693, to form the step surface 695. The guide surface 696 is configured to abut against the matching end 660. When the button 69 is in a third position, the matching end 660 is in the second position, and the matching end 660 abuts against the first end 697 of the guide surface 696. When the button 69 is in a fourth position, the matching end 660 is in the first position, and the matching end 660 abuts against the second end 698 of the guide surface 696.

Each second spring 70 is partially accommodated in one accommodation blind hole 692, is in the compressed state, and is configured to provide upward acting force for the button 69. When the button 69 is operated, each second spring 70 is further compressed and changes a shape, and provides elastic force for the button 69 to resume an original position when external force applied to the button 69 disappears. Each second spring 70 is configured to provide second acting force F2 for the button 69 when the button 69 is not operated. The second acting force F2 is greater than the first acting force F1. Therefore, when the button 69 is released from an operation, the spring bar pin 66 may be pushed through the guide surface 696 until the mounting end 661 of the spring bar pin 66 is accommodated in the shaft hole 511.

In this embodiment, the elastic force provided by the second spring 70 needs to push the mounting end 661 of the spring bar pin 66 to move to the shaft hole 511. Therefore, the elastic force provided by the second spring 70 is relatively large, and larger downward force needs to be applied to the button 69, to prevent the button 69 from detaching from the connection part 64. In this solution, the cover 71 is above the connection part 64, and the cover 71 abuts against the button 69, to prevent the button 69 from detaching from the connection part 64. The cover 71 includes a button slot 711 that runs through opposite surfaces of the cover 71 and through an edge of the cover 71. The operation part 693 of the button 69 is exposed from the cover 71 through the button slot 711. Specifically, the operation part 693 of the button 69 passes through the button slot 711 and is exposed from the cover 71, so that the user can operate the button 69. The cover 71 abuts against the step surface 695, so that the cover 71 applies one downward third acting force F3 to the button 69, to offset the second acting force F2 provided by the second spring 70 for the button 69. The button 69 is limited to the second accommodation cavity 642, to prevent the button 69 from detaching from the connection part 64. This has a mass production capability. The third acting force F3 is greater than the second acting force F2. In this embodiment, the cover 71 is fastened to the connection part 64. Specifically, the cover 71 includes a cover body 712 and a lip edge 713 provided at a side edge of the cover body 712. The button slot 711 runs through opposite surfaces of the cover body 712 and through an edge of the cover body 712. The cover body 712 is accommodated in the accommodation groove 650, and the lip edge 713 is accommodated in the sliding groove 651. In this embodiment, a limit snap-fit 715 may be further disposed far away from the edge on a side 714 that is of the cover body 712 and that faces the bottom surface 648. The limit snap-fit 715 is clamped on the inner wall 645 of the connection part 64 through the spacing.

Figure 5:
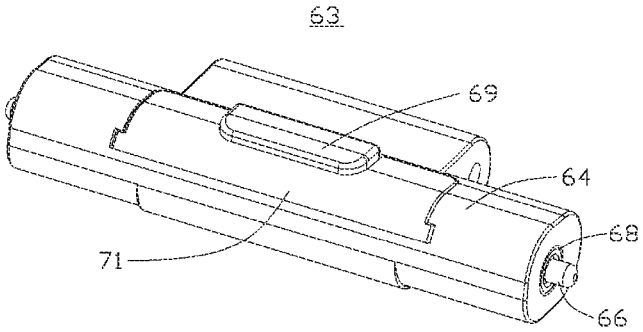
FIG. 5 is a schematic diagram of a connection base of a watch band of the watch according to the first embodiment of this application.
Figure 6:
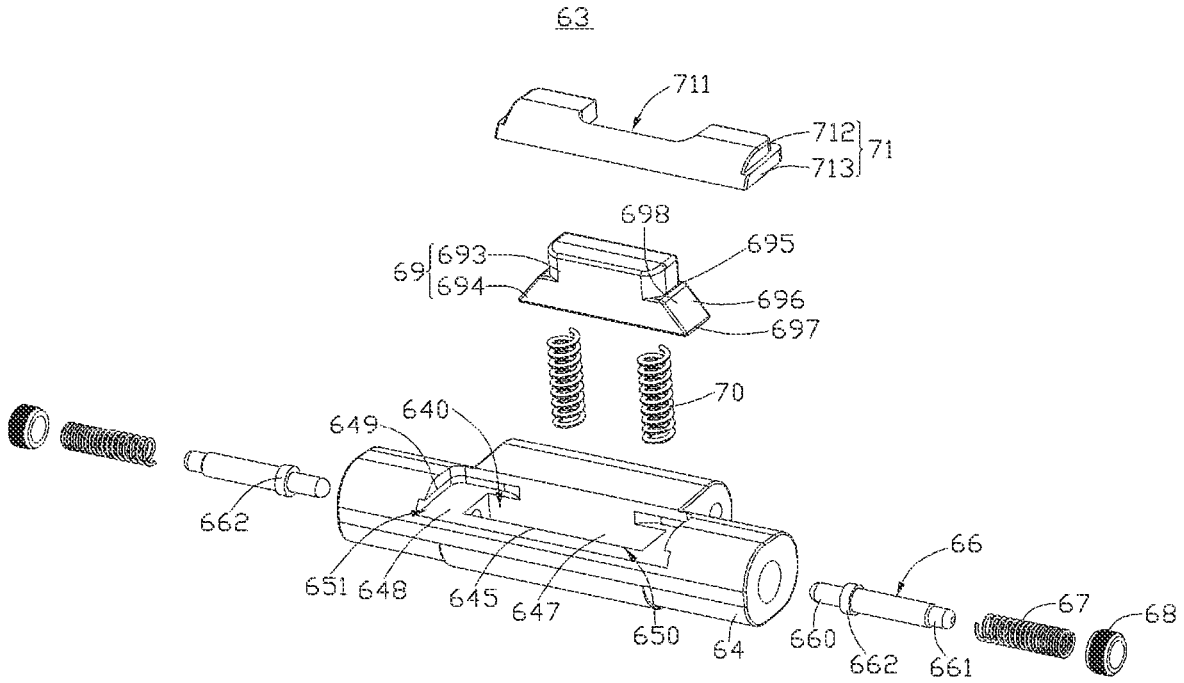
FIG. 6 is a schematic exploded view of the connection base in FIG. 5.
Figure 7:
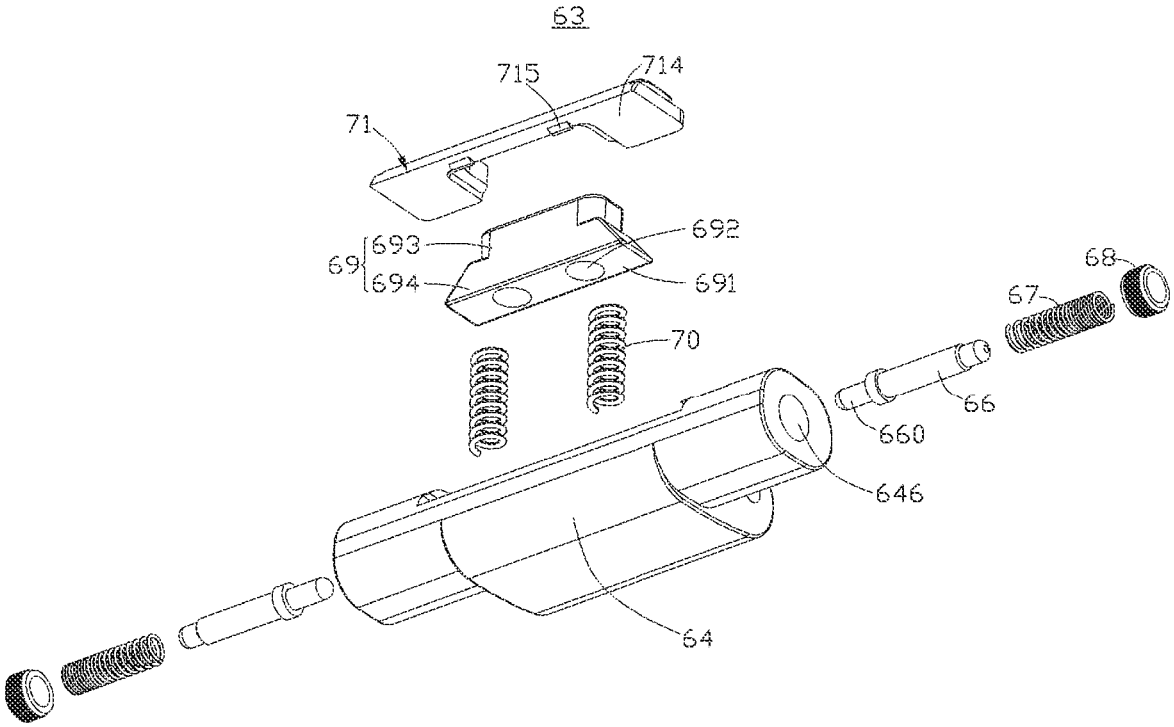
FIG. 7 is a schematic exploded view of the connection base in FIG. 5 from another perspective.
Figure 8:
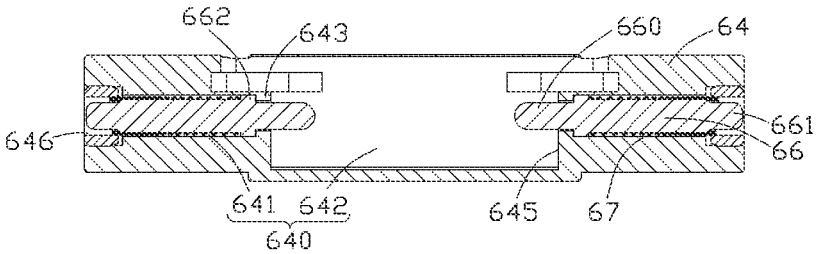
FIG. 8 is a schematic sectional diagram 1 of the connection base in FIG. 5 in an assembly process.
Figure 9:
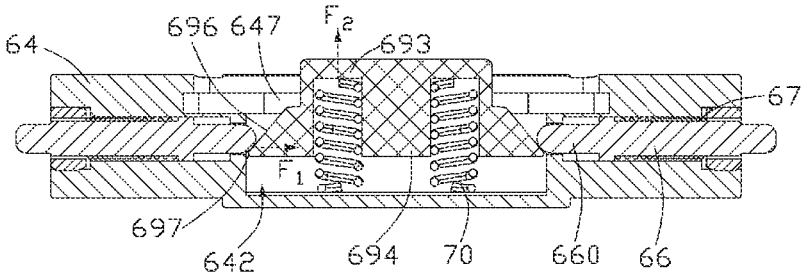
FIG. 9 is a schematic sectional diagram 2 of the connection base in FIG. 5 in an assembly process.
Figure 10:
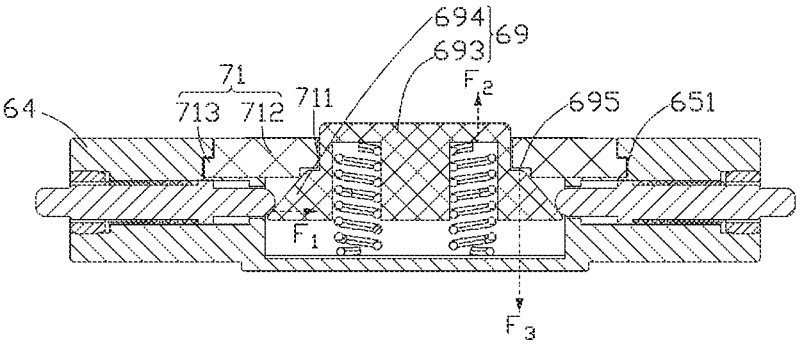
FIG. 10 is a schematic sectional diagram 3 of the connection base in FIG. 5 in an assembly process.

Refer to FIG. 8, FIG. 9, and FIG. 10. During assembly, the first spring 67 is first sleeved on the spring bar pin 66, the spring bar pin 66 and the first spring 67 are placed together in the first accommodation cavity 641 through the first opening 646, and then the clamping ring 68 is fastened to the first opening 646. In this case, the spring bar pin 66 and the first spring 67 are limited in the connection part 64. The abut member 662 abuts against the limit member 643, the first spring 67 is in a compressed state, and the matching end 660 of the spring bar pin 66 is in the first position, as shown in FIG. 8. At least two second springs 70 are disposed in the at least two accommodation blind holes 692, to apply acting force to the spring bar pins 66, so that the matching ends 660 move from the first position to the second position and move in a direction away from the second position. The button 69 and the second springs 70 are placed together in the second accommodation cavity 642 through the second opening 647, so that the second springs 70 abut against the connection part 64 in the second accommodation cavity 642, and then the acting force applied to the spring bar pins 66 is removed. In this case, the matching end 660 of the spring bar pin 66 moves toward the first position under acting force of the first spring 67. The matching end 660 abuts against the guide surface 696, to apply acting force to the button 69. The second spring 70 provides the upward acting force for the button 69, so that the button 69 applies one reaction force to the spring bar pin 66 until the matching end 660 is in the second position. The matching end 660 abuts against the first end 697 of the guide surface 696, and the button 69 is in the third position. In this case, the matching end 660 applies the first acting force F1 to the button 69, the second spring 70 provides the second acting force F2 for the button 69. The second acting force F2 is greater than the first acting force F1, and the button 69 is detached from the connection part 64 under the acting force provided by the second spring 70 for the button 69, as shown in FIG. 9. The first acting force F1 and the second acting force F2 are represented by dashed lines. The lip edge 713 of the cover 71 slides along the sliding groove 651, so that the cover body 712 of the cover 71 is accommodated in the accommodation groove 650 (as shown in FIG. 5). In this case, the limit snap-fit 715 (as shown in FIG. 7) is located above the spacing. The limit snap-fit 715 is pressed into the spacing and abuts against the inner wall 645 (as shown in FIG. 6) of the connection part 64, so that the cover 71 is fastened to the connection part 64. In this case, the operation part 693 of the button 69 passes through the button slot 711 of the cover 71, and is exposed from the cover 71 in the third position. In addition, the cover 71 applies downward force F3 to the button 69 by using the step surface 695 of the button 69, to offset the second acting force F2 provided by the second spring 70 for the button 69, and the button 69 is limited in the connection part 64, as shown in FIG. 10. The third acting force F3 is represented by a dashed line.

Figure 11:
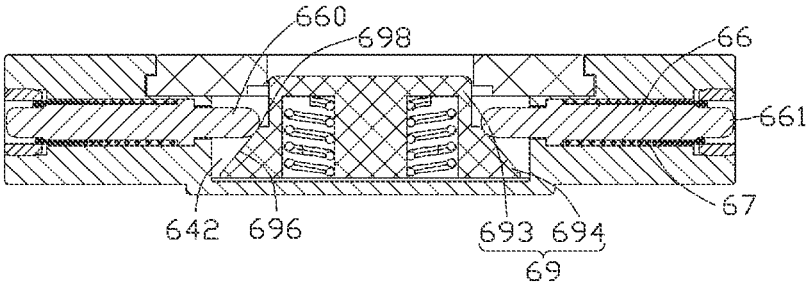
FIG. 11 is a sectional diagram shown when a button of the connection base in FIG. 5 is operated.

Refer to both FIG. 4 and FIG. 10. When the watch band 61 needs to be disassembled or assembled, the operation part 693 of the button 69 is operated, and the button 69 slides in the second accommodation cavity 642 to the fourth position. The two binaural levers 66 move toward each other along the guide surfaces 696 under the elastic force provided by the first springs 67 until the matching ends 660 move to the first position. In this case, the matching end 660 abuts against the second end 698 of the guide surface 696. When the two matching ends 660 are in the first position, the two first springs 67 are in the compressed state. Therefore, when the matching ends 660 are in the second position, the elastic force provided by the first spring 67 enables the matching ends 660 to move to the first position and the mounting ends 661 to move to the connection part 64, as shown in FIG. 11. In this case, the watch band 61 may be disassembled from or assembled to the watch body 51.

In this application, the two second springs 70 provide the relatively large elastic force toward the outside of the connection part 64 for the button 69, and provide, through the guide surfaces 696 when the button 69 is not operated, the elastic force for the two spring bar pins 66 to move away from each other, so that the spring bar pins 66 are pushed to enable the mounting ends 661 of the spring bar pins 66 to be accommodated in the shaft holes 511 of the watch body 51. This has a mass production capability, and can implement quick locking of the watch band 61 and the watch body 51. In addition, the cover 71 is fastened to the connection part 64, to offset the upward elastic force provided by the second springs 70 for the button 69, to prevent the button 69 from detaching from the connection part 64 under the elastic force of the second springs 70. This has a mass production capability. The button 69 is operated, so that the mounting ends 661 of the spring bar pins 66 contract inward under the elastic force of the first springs 67. This implements quick unlocking of the watch band 61 and the watch body 51. The button is disposed, to provide good pressing operation experience. Skin and clothes are not likely to be scratched, and a watch appearance is beautiful. The limit snap-fit 715 is clamped on the inner wall 645 of the connection part 64 through the spacing, so that the cover 71 may be securely locked on the connection part 64. The second spring 70 is in the compressed state when the button 69 is not operated, so that the button 69 may apply the relatively strong acting force to the spring bar pin 66. In this case, the mounting end 661 of the spring bar pin 66 can move and is accommodated in the shaft hole 511 of the watch body 51. When the matching ends 660 are in the first position, that is, when the mounting ends 661 are far away from the shaft holes 511, the first springs 67 are in the compressed state. In this way, when the matching ends 660 are in the second position, that is, when the mounting ends 661 are accommodated in the shaft holes 511, the elastic force provided by the first springs 67 may enable the mounting ends 661 to move out of the shaft holes 511. This allows the watch band 61 to be disassembled from the watch body 51. The limit member 643 is formed by extending inward in the radial direction from the inner wall 645 of the connection part 64 at the connection at which the first accommodation cavity 641 communicates with the second accommodation cavity 642. In this way, when the abut member 662 enters the second accommodation cavity 642, the abut member 662 is not stuck in the inner wall 645 of the connection part 64 at the connection at which the first accommodation cavity 641 communicates with the second accommodation cavity 642, to avoid that the button 69 cannot be assembled. This has a mass production capability. The diameter of the mounting end 661 is less than the diameter of the another part of the spring bar pin 66, so that the spring bar pin 66 has relatively high impact-resistance strength and good drop resistance. A first unit 41 is the watch body 51, and a second unit 42 is the watch band 61, so that inconvenient assembly caused by an excessively narrow connection base 63 can be prevented.

Figure 12:
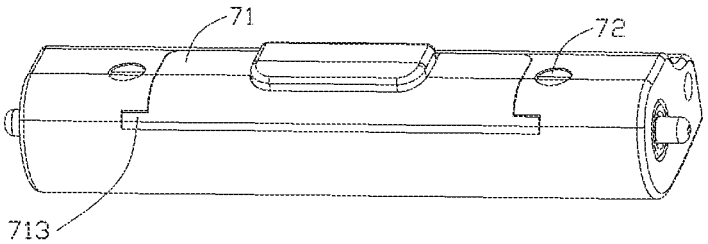
FIG. 12 is a schematic diagram of a connection base of a watch band of a watch according to a second embodiment of this application.

FIG. 12 is a schematic diagram of a connection base of a watch band of a watch according to a second embodiment of this application. The watch in the second embodiment is similar to the watch in the first embodiment. A difference lies in that a limit snap-fit is omitted in a cover of the connection base in the second embodiment. The cover is not securely locked on the connection part by using the limit snap-fit, but is securely locked on the connection part by using a fixing member. Details are provided below.

Figure 13:
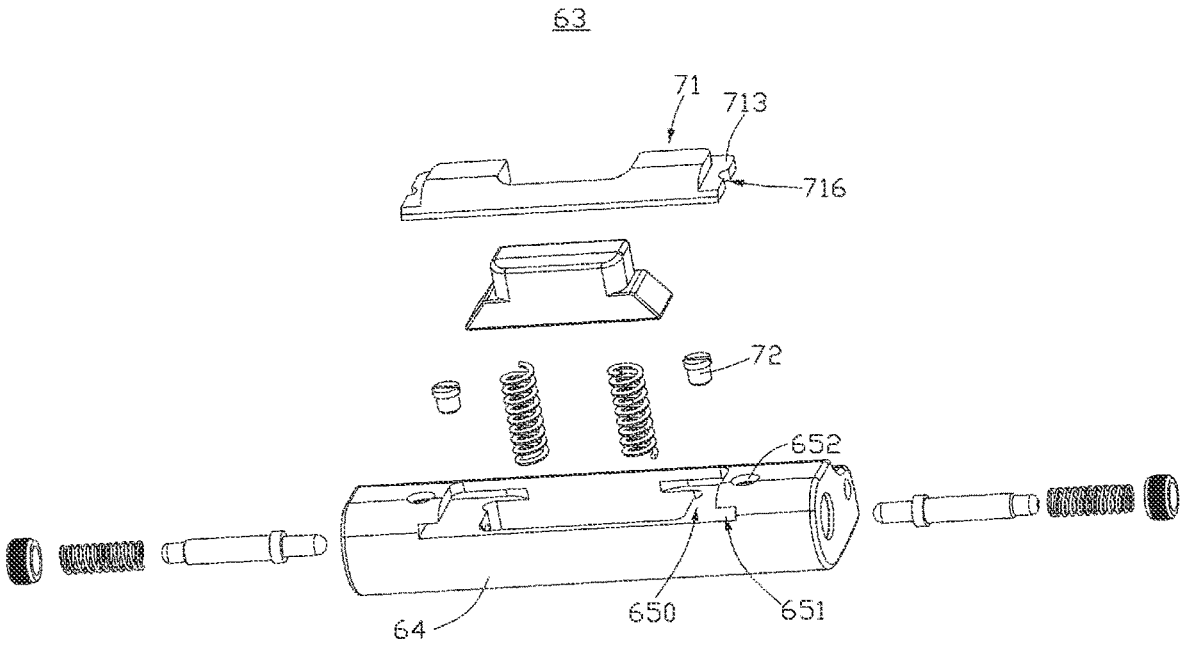
FIG. 13 is a schematic exploded view of the connection base in FIG. 12.
Figure 14:
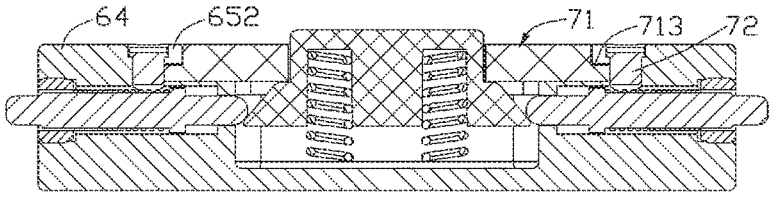
FIG. 14 is a sectional diagram of the connection base in FIG. 12.

Refer to FIG. 13 and FIG. 14. The connection base 63 further includes the fixing member 72. In this embodiment, the fixing member 72 may be a screw; a bolt, or the like. A lip edge 713 of a cover 71 includes a crescent hole 716 provided at an edge of the lip edge 713. In this embodiment, the lip edge 713 of the cover 71 includes the crescent hole 716 that runs through opposite surfaces of the lip edge 713 and through the edge of the lip edge 713. In this embodiment, there are two crescent holes 716, symmetrically provided in lip edges 713. The crescent hole 716 may be a threaded hole or a penetration hole. The crescent hole 716 is provided, so that the lip edge 713 does not need to be relatively wide. This simplifies a processing process of the sliding groove 651, reduces process implementation complexity, and is suitable for industrial mass production. A through hole 652 is formed in the connection part 64 near an accommodation groove 650. The through hole 652 may be a threaded hole or a penetration hole. The through hole 652 is used to accommodate a part of the fixing member 72, and the crescent hole 716 is used to accommodate the other part of the fixing member 72. In this way, the cover 71 is securely locked on the connection part 64 by using the crescent bole 716, the through hole 652, and the fixing member 72. The cover 71 is securely locked on the connection part 64 by using the fixing member 72, which facilitates assembly, disassembly, and repair of the cover 71, and improves a mass production capability of the watch.

Figure 15:
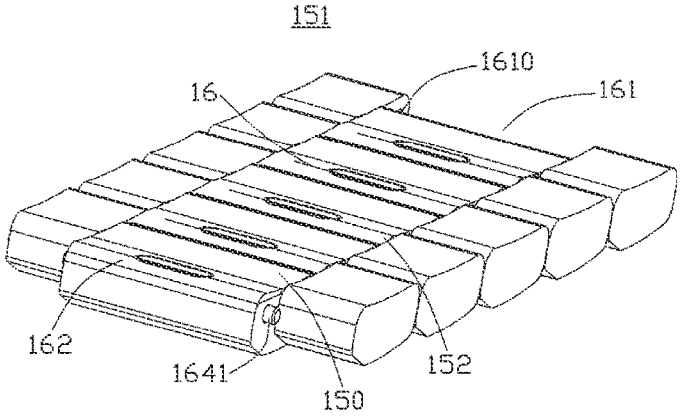
FIG. 15 is a schematic diagram of a watch band of a watch according to a third embodiment of this application.

FIG. 15 is a schematic diagram of a watch band of a watch according to a third embodiment of this application. The watch in the third embodiment is similar to the watch in the first embodiment. A difference lies in that, a first unit, a second unit, a structure of a connection base, a structure of a connection part, a structure of a spring bar pin, and a method for assembling the watch in the third embodiment are different from the first unit, the second unit, the structure of the connection base, the structure of the connection part, the structure of the spring bar pin, and the method for assembling the watch in the first embodiment. Details are provided below.

Figure 16:
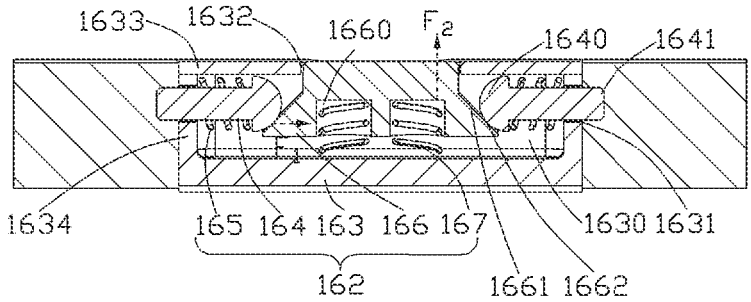
FIG. 16 is a sectional diagram of the watch band in FIG. 15.

Refer to FIG. 16. The first unit 150 is a link 16 of the watch band 151, and the second unit 152 is another link 16 of the watch band 151. In the third embodiment, the link 16 is disassembled or assembled, to adjust a length of the watch band 151. A first end of the link 16 of the watch band 151 includes a concave connection slot 161. A second end of the link 16 of the watch band 151 includes a raised connection base 162. The second end is opposite to the first end. The watch band 151 is formed by connecting a connection base 162 of one link 16 to a connection slot 161 of another link 16. Shaft holes 1610 that are oppositely provided in a connection slot 161 of each link 16. The connection base 162 includes a connection part 163, two spring bar pins 164, two first springs 165, a button 166, and two second springs 167. The connection part 163 includes an accommodation cavity 1630. The accommodation cavity 1630 includes two opposite first openings 1631 and one second opening 1632. In this embodiment, the connection part 163 is divided into two parts at the two first openings 1631: a first part 1633 and a second part 1634. The first part 1633 is an upper part, and the second part 1634 is a lower part. The upper part and the lower part form the connection part 163.

Each spring bar pin 164 is slidably disposed in the accommodation cavity 1630, and may be exposed from the connection part 163 through the first opening 1631, to be accommodated in the shaft hole 1610. The spring bar pin 164 includes a matching end 1640 and a mounting end 1641. A diameter of the matching end 1640 is greater than a diameter of the mounting end 1641, so that a connection between the matching end 1640 and the mounting end 1641 is in a stepped shape. Each first spring 165 is sleeved on the spring bar pin 164. A first end of each first spring 165 abuts against the step-shaped connection, and a second end of each first spring 165 abuts against an inner wall that is of the connection part 163 and that is near the first opening 1631. The button 166 is slidably disposed in the accommodation cavity 1630. A sliding direction of the button 166 is perpendicular to a sliding direction of the spring bar pin 164. The button 166 is exposed from the connection part 163 through the second opening 1632, so that the button 166 can be operated by a user to slide in the accommodation cavity 1630.

During assembly, the first spring 165 is first sleeved on the spring bar pin 164, and the spring bar pin 164 and the first spring 165 are placed together in the second part 1634. At least two second springs 167 are disposed in at least two accommodation blind holes 1660 of the button 166, to apply acting force to the spring bar pins 164, so that the matching ends 1640 move to second position and move in a direction away from the second position. The button 166 and the second springs 167 are placed together in the second part 1634, and then the acting force applied to the spring bar pins 164 is removed. In this case, the matching end 1640 of the spring bar pin 164 moves toward a first position under acting force of the first spring 165. The matching end 1640 abuts against a guide surface 1661, to apply acting force to the button 166. The second spring 167 provides upward acting force for the button 166, so that the button 166 applies reaction force to the spring bar pin 164 until the matching end 1640 is in the second position. The matching end 1640 abuts against a first end 1662 of the guide surface 1661, and the button 166 is in a third position. In this case, the matching end 1640 applies first acting force F1 to the button 166, the second spring 167 provides second acting force F2 for the button 166. The second acting force F2 is greater than the first acting force F1, and the button 166 is detached from the connection part 163 under the acting force provided by the second spring 167 for the button 166. The first acting force F1 and the second acting force F2 are represented by dashed lines. In this case, the first part 1633 may be welded to the second part 1634, to offset, by using the first part 1633, the second acting force F2 provided by the second spring 167 for the button 166. The button 166 is limited in the connection part 163, to implement integration. In this way, even a narrow second unit 152 may be conveniently assembled.

Clearly, the third embodiment may further have another variant. For example, a structure of the connection base 162 changes a shape and includes the cover in the first embodiment, and a structure of the connection part 163 changes a shape and includes the accommodation groove and the sliding groove in the first embodiment. In the third embodiment, the second acting force F2 provided by the second spring 167 for the button 166 may also be offset by the cover, and the button 166 is limited in the connection part 163. For example, the accommodation cavity 1630 changes a shape and changes into a T-shaped accommodation cavity, the structure of the connection part 163 changes a shape and includes the limit member in the first embodiment, and a structure of the spring bar pin 164 changes a shape and changes into the spring bar pin in the first embodiment. In this way, in a sliding process of the spring bar pin 164, an abut member is not stuck in an inner wall of the connection part at a connection at which a first accommodation cavity communicates with a second accommodation cavity. For example, the structure of the spring bar pin 164 changes a shape and the diameter of the mounting end 1641 is less than a diameter of another part of the spring bar pin 164, so that the spring bar pin 164 has relatively high impact-resistance strength and good drop resistance.

Figure 17:
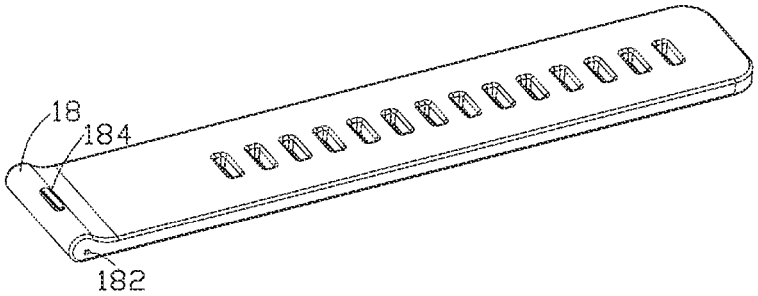
FIG. 17 is a schematic diagram of a watch band of a watch according to a fourth embodiment of this application.

FIG. 17 is a schematic diagram of a watch according to a fourth embodiment of this application. The watch in the fourth embodiment is similar to the watch in the first embodiment. A difference lies in that, a structure of a watch band, a structure of a connection base, a structure of a connection part, a structure of a spring bar pin, and a method for assembling the watch in the fourth embodiment are different from the first unit, the second unit, the structure of the connection base, the structure of the connection part, the structure of the spring bar pin, and the method for assembling the watch in the first embodiment. Details are provided below.

Figure 18:
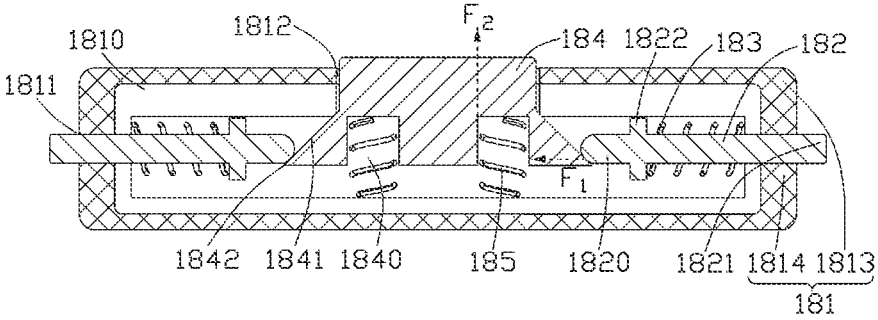
FIG. 18 is a sectional diagram of the watch band in FIG. 17.

Refer to FIG. 18. A watch band 17 is a soft rubber watch band, a leather watch band, a woven watch band, or the like. A connection base 18 includes a connection part 181, two spring bar pins 182, two first springs 183, a button 184, and two second springs 185. The connection part 181 includes an accommodation cavity 1810. The accommodation cavity 1810 includes two opposite first openings 1811 and one second opening 1812. In this embodiment, the connection part 181 is divided into two parts at the two first openings 1811: a first part 1813 and a second part 1814. The first part 1813 is an upper part, and the second part 1814 is a lower part. The upper part and the lower part form the connection part 181.

Each spring bar pin 182 is slidably disposed in the accommodation cavity 1810, and may be exposed from the connection part 181 through the first opening 1811, to be accommodated in a shaft hole. The spring bar pin 182 includes a matching end 1820 and a mounting end 1821. The spring bar pin 182 further includes an abut member 1822 between the matching end 1820 and the mounting end 1821. Each first spring 183 is sleeved on the spring bar pin 182. A first end of each first spring 183 abuts against the abut member 1822, and a second end opposite to the first end abuts against an inner wall that is of the connection part 181 and that near the first opening 1811. The button 184 is slidably disposed in the accommodation cavity 1810. A sliding direction of the button 184 is perpendicular to a sliding direction of the spring bar pin 182. The button 184 is exposed from the connection part 181 through the second opening 1812, so that the button 184 can be operated by a user to slide in the accommodation cavity 1810.

During assembly, the first spring 183 is first sleeved on the spring bar pin 182, and the spring bar pin 182 and the first spring 183 are placed together in the second part 1814. At least two second springs 185 are disposed in at least two accommodation blind holes 1840 of the button 184, to apply acting force to the spring bar pins 182, so that the matching ends 1820 move to second position and move in a direction away from the second position. The button 184 and the second springs 185 are placed together in the second part 1814, and then the acting force applied to the spring bar pins 182 is removed. In this case, the matching end 1820 of the spring bar pin 182 moves toward a first position under acting force of the first spring 183. The matching end 1820 abuts against a guide surface 1841 of the button 184, to apply acting force to the button 184. The second spring 185 provides upward acting force for the button 184, so that the button 184 applies reaction force to the spring bar pin 182 until the matching end 1820 is in the second position. The matching end 1820 abuts against a first end 1842 of the guide surface 1841, and the button 184 is in a third position. In this case, the matching end 1820 applies first acting force F1 to the button 184, the second spring 185 provides second acting force F2 for the button 184. The second acting force F2 is greater than the first acting force F1, and the button 184 is detached from the connection part 181 under the acting force provided by the second spring 185 for the button 184. The first acting force F1 and the second acting force F2 are represented by dashed lines. In this case, the first part 1813 may be welded to the second part 1814, to offset, by using the first part 1813, the second acting force F2 provided by the second spring 185 for the button 184. The button 184 is limited in the connection part 181, to implement integration. In this way, even if the connection base 18 is narrow, assembly is convenient.

Clearly the fourth embodiment may further have another variant. For example, a structure of the connection base 18 changes a shape and includes the cover in the first embodiment, and a structure of the connection part 181 changes a shape and includes the accommodation groove and the sliding groove in the first embodiment. In the third embodiment, the second acting force F2 provided by the second spring 185 for the button 184 may also be offset by the cover, and the button 184 is limited in the connection part 181. For example, the accommodation cavity 1810 changes a shape and changes into a T-shaped accommodation cavity, and the structure of the connection part 181 changes a shape and includes the limit member in the first embodiment. In this way, in a sliding process of the spring bar pin, an abut member is not stuck in an inner wall of the connection part at a connection at which a first accommodation cavity communicates with a second accommodation cavity. For example, the structure of the spring bar pin 182 changes a shape and a diameter of the mounting end 1821 is less than a diameter of another part of the spring bar pin 182, so that the spring bar pin 182 has relatively high impact-resistance strength and good drop resistance.

Finally, it should be noted that the foregoing embodiments are merely intended for describing the technical solutions of this application, but not for limiting the technical solutions of this application. Although this application is described in detail with reference to an example embodiment, a person of ordinary skill in the art should understand that modifications or equivalent replacements may be made to the technical solutions of this application, without departing from the spirit and scope of the technical solutions of this application.

What is claimed is:

1. A wearable electronic apparatus comprising:
a body comprising a shaft hole; and
a band comprising:
a connection part comprising:
an outside;
an accommodation cavity comprising:
two first openings; and
a second opening; and
a surface that is concave at a first edge to form:
a bottom surface, wherein the second opening is in the bottom surface; and
a step-shaped side wall coupled to the bottom surface, wherein the bottom surface and the step-shaped side wall are configured to form:
an accommodation groove in communication with the accommodation cavity through the second opening; and
a sliding groove at a connection between the step-shaped side wall and the bottom surface;
a button, slidable in a first sliding direction, disposed in the accommodation cavity at the second opening, and comprising inclined guide surfaces;
two spring bar pins, wherein each spring bar pin is slidable in a second sliding direction perpendicular to the first sliding direction, disposed in the accommodation cavity at one of the two first openings, and comprises:
a matching end configured to cooperate with the button through the inclined guide surfaces; and
a mounting end located opposite to the matching end and configured to be accommodated in the shaft hole;
two first springs configured to:
provide a first elastic force for biasing the two spring bar pins to move toward each other; and
enable the two spring bar pins to apply a first acting force to the button when mounting ends of the two spring bar pins are accommodated in shaft holes;
two second springs configured to:
provide a second elastic force biasing the button toward the outside;
provide, through the inclined guide surfaces, a third elastic force for causing the two spring bar pins to move away from each other to accommodate the mounting ends in the shaft holes; and
provide a second acting force for the button when the button is not operated, wherein the second acting force is greater than the first acting force; and
a cover fastened to the connection part, configured to abut against the button, and comprising:
a cover body accommodated in the accommodation groove and comprising:
a side edge;
first opposite surfaces; and
a second edge;
a lip edge accommodated in the sliding groove and provided at the side edge; and
a button slot to partially expose the button, wherein the button slot extends through the first opposite surfaces and through the second edge.

2. The wearable electronic apparatus of claim 1, wherein the connection part further comprises an inner wall, wherein the cover body comprises a side facing the bottom surface, and wherein the wearable electronic apparatus further comprises:
a spacing between the button and the inner wall; and
a limit snap-fit disposed distal from the side edge and clamped on the inner wall through the spacing.

3. The wearable electronic apparatus of claim 1, further comprising:
a fixing member comprising:
a first part; and
a second part; and
a through-hole in the connection part proximate to the accommodation groove and configured to accommodate the first part,
wherein the lip edge comprises:
a third edge; and
a crescent hole at the third edge and configured to accommodate the second part.

4. The wearable electronic apparatus of claim 3, wherein the lip edge further comprises second opposite surfaces, wherein the crescent hole extends through the second opposite surfaces and through the third edge, and wherein the through hole is a threaded hole or a penetration hole.

5. The wearable electronic apparatus of claim 1, wherein the two second springs are in a compressed state when the button is not operated.

6. The wearable electronic apparatus of claim 1, wherein the two first springs are in a compressed state when the mounting ends are distal from the shaft holes.

7. The wearable electronic apparatus of claim 1, wherein the accommodation cavity further comprises:
two first accommodation cavities; and
a second accommodation cavity provided between the two first accommodation cavities and in communication with each of the two first accommodation cavities,
wherein the connection part further comprises a limit member at a connection at which each of the two first accommodation cavities are coupled to the second accommodation cavity,
wherein each of the two spring bar pins further comprises an abut member located between the matching end and the mounting end, wherein a first diameter of the abut member is greater than a second diameter of the matching end and further greater than a third diameter of the mounting end, and wherein the abut member is configured to abut against the limit member.

8. The wearable electronic apparatus of claim 1, wherein a first diameter of the mounting end is less than a second diameter of another part of each of the two spring bar pins.

9. The wearable electronic apparatus of claim 1, wherein the body is a watch body, and wherein the band is a watch band.

10. The wearable electronic apparatus of claim 1, wherein the body further comprises:
a memory configured to store instructions;
an antenna configured to transmit and receive signals;

a wireless charging component configured to charge the body;

a display configured to prompt information; and one or more processors coupled to the memory, the antenna, the wireless charging component, and the display and configured to control the body.

11. The wearable electronic apparatus of claim 1, wherein the band further comprises:

a plurality of links; and a connection base comprising:

a first end coupled to the links; and a second end detachably coupled to the body through the shaft holes.

12. The wearable electronic apparatus of claim 1, wherein the accommodation cavity has a T-shape.

13. The wearable electronic apparatus of claim 1, wherein the band further comprises a clamping ring fastened to each of the two first openings with an interference fit.

14. The wearable electronic apparatus of claim 1, wherein the band further comprises a clamping ring fastened to each of the two first openings using a thread connection.

15. The wearable electronic apparatus of claim 1, wherein the band further comprises a clamping ring fastened to each of the two first openings by welding.

16. The wearable electronic apparatus of claim 1, wherein the band further comprises a concave connection slot.

17. The wearable electronic apparatus of claim 1, wherein the band further comprises a raised connection base.

18. The wearable electronic apparatus of claim 1, wherein the band is a soft rubber watch band, a leather watch band, or a woven watch band.

19. An apparatus comprising:

a body comprising a shaft hole; and a band comprising:

a connection part comprising:

an outside;

an accommodation cavity comprising:

two first openings; and a second opening; and a surface that is concave at a first edge to form:

a bottom surface, wherein the second opening is in the bottom surface; and a step-shaped side wall coupled to the bottom surface, wherein the bottom surface and the step-shaped side wall are configured to form:

an accommodation groove in communication with the accommodation cavity through the second opening; and a sliding groove at a connection between the step-shaped side wall and the bottom surface;

a button, slidable in a first sliding direction, disposed in the accommodation cavity at the second opening, and comprising inclined guide surfaces;

two spring bar pins, wherein each spring bar pin is slidable in a second sliding direction perpendicular to the first sliding direction, disposed in the accommodation cavity at one of the two first openings, and comprises:

a matching end configured to cooperate with the button through the inclined guide surfaces; and a mounting end located opposite to the matching end and configured to be accommodated in the shaft hole;

two first springs;

two second springs; and a cover fastened to the connection part, configured to abut against the button, and comprising:

a cover body accommodated in the accommodation groove and comprising:

a side edge;

first opposite surfaces; and a second edge;

a lip edge accommodated in the sliding groove and provided at the side edge; and a button slot to partially expose the button, wherein the button slot extends through the first opposite surfaces and through the second edge.

20. An apparatus comprising:

a body; and a band comprising:

a connection part comprising:

an outside;

an accommodation cavity comprising:

two first openings; and a second opening; and a surface that is concave at a first edge to form:

a bottom surface, wherein the second opening is in the bottom surface; and a step-shaped side wall coupled to the bottom surface, wherein the bottom surface and the step-shaped side wall are configured to form:

an accommodation groove in communication with the accommodation cavity through the second opening; and a sliding groove at a connection between the step-shaped side wall and the bottom surface;

a button;

two spring bar pins, wherein each spring bar pin comprises:

a matching end; and a mounting end;

two first springs configured to:

provide a first elastic force for biasing the two spring bar pins to move toward each other; and enable the two spring bar pins to apply a first acting force to the button when mounting ends of the two spring bar pins are accommodated in shaft holes;

two second springs configured to:

provide a second elastic force biasing the button toward the outside;

provide a third elastic force for causing the two spring bar pins to move away from each other to accommodate the mounting ends in the shaft holes; and provide a second acting force for the button when the button is not operated, wherein the second acting force is greater than the first acting force; and a cover fastened to the connection part, configured to abut against the button, and comprising:

a cover body accommodated in the accommodation groove and comprising:

a side edge;

first opposite surfaces; and a second edge;

a lip edge accommodated in the sliding groove and provided at the side edge; and a button slot to partially expose the button, wherein the button slot extends through the first opposite surfaces and through the second edge.

* * * * *